US010791904B2

(12) United States Patent
Wu

(10) Patent No.: US 10,791,904 B2
(45) Date of Patent: Oct. 6, 2020

(54) ROTARY DEWATERING MOP DEVICE

(71) Applicant: Chang-Hsin Wu, Yunlin County (TW)

(72) Inventor: Chang-Hsin Wu, Yunlin County (TW)

( * ) Notice: Subject to any disclaimer, the term of this patent is extended or adjusted under 35 U.S.C. 154(b) by 17 days.

(21) Appl. No.: 16/162,074

(22) Filed: Oct. 16, 2018

(65) Prior Publication Data

US 2020/0069142 A1 Mar. 5, 2020

(30) Foreign Application Priority Data

Aug. 30, 2018 (TW) ..... 107211893 U

(51) Int. Cl.
*A47L 13/142* (2006.01)
*A47L 13/258* (2006.01)
*A47L 13/256* (2006.01)

(52) U.S. Cl.
CPC ..... *A47L 13/142* (2013.01); *A47L 13/256* (2013.01); *A47L 13/258* (2013.01)

(58) Field of Classification Search
CPC ..... A47L 13/14; A47L 13/142; A47L 13/256; A47L 13/258
USPC ..... 15/119.1
See application file for complete search history.

(56) References Cited

U.S. PATENT DOCUMENTS 4,843,674 A * 7/1989 Jones ..... A47L 13/258 15/147.1
9,615,717 B2 * 4/2017 Zhu ..... A47L 13/14
2005/0152737 A1 * 7/2005 Tien ..... A47L 13/22 401/270

FOREIGN PATENT DOCUMENTS

FR 3058884 A3 * 5/2018 ..... B25H 1/04

* cited by examiner

*Primary Examiner* — Laura C Guidotti

(57) ABSTRACT

A rotary dewatering mop device comprises an outer casing, a barrel, a cleaning assembly and a holding assembly. The cleaning assembly is pulled upward through the holding assembly to be placed in the barrel and is moved upward and downward reciprocatically through a handheld rod to drive the barrel and the cleaning assembly to generate a centrifugal force of rotation, thereby achieving rapid dewatering.

9 Claims, 13 Drawing Sheets

ROTARY DEWATERING MOP DEVICE

BACKGROUND OF THE INVENTION

Field of Invention

The present invention relates to a rotary dewatering mop device, and more particularly to a mop device structure that achieves dewatering by means of rotation.

Related Art

Mop is one of the most commonly used cleaning tools for consumers. However, the most criticized defect of the mop is the problem of dewatering. Most traditional mops must be dewatered by manual twisting by the user, but in addition to being laborious and time-consuming, the hands will be contaminated with the dirt on the mop. Therefore, in order to solve the problem of dewatering, so-called rotary mops have been developed in recent years, mainly by placing the mop in a container with a roller, and the mop is dewatered by the centrifugal force of rotation of the roller. However, this type of rotary mop requires repeated actions of filling the container with water and emptying the dirty water. In addition to being laborious and time-consuming, when the mop is not used, it is necessary to vacate the storage space to place the mop and the container. For the user, there are still many inconveniences and defects.

Therefore, how to improve the above-mentioned defects and problems is the technical difficulty that the inventor of the present invention wants to solve.

SUMMARY OF THE INVENTION

A main object of the present invention is to provide a rotary dewatering mop device mainly composed of an outer casing, a barrel, a cleaning assembly and a holding assembly. The cleaning assembly is pulled up through the holding assembly to be placed in the barrel and is moved upward and downward reciprocatically through a handheld rod to drive the barrel and the cleaning assembly to generate a centrifugal force of rotation, thereby achieving rapid dewatering.

DETAILED DESCRIPTION OF THE INVENTION

Figure 1:
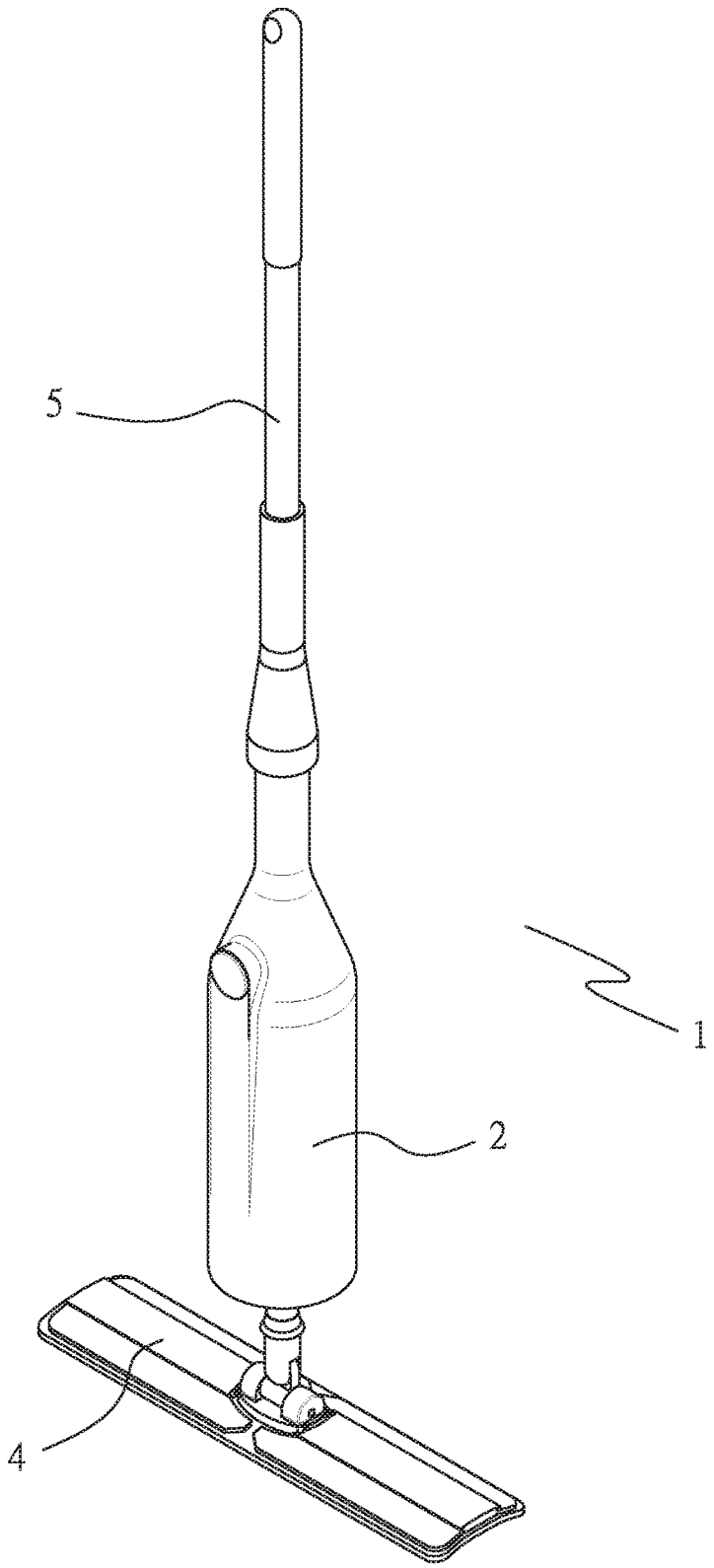
FIG. 1 is a perspective view of the present invention.
Figure 2:
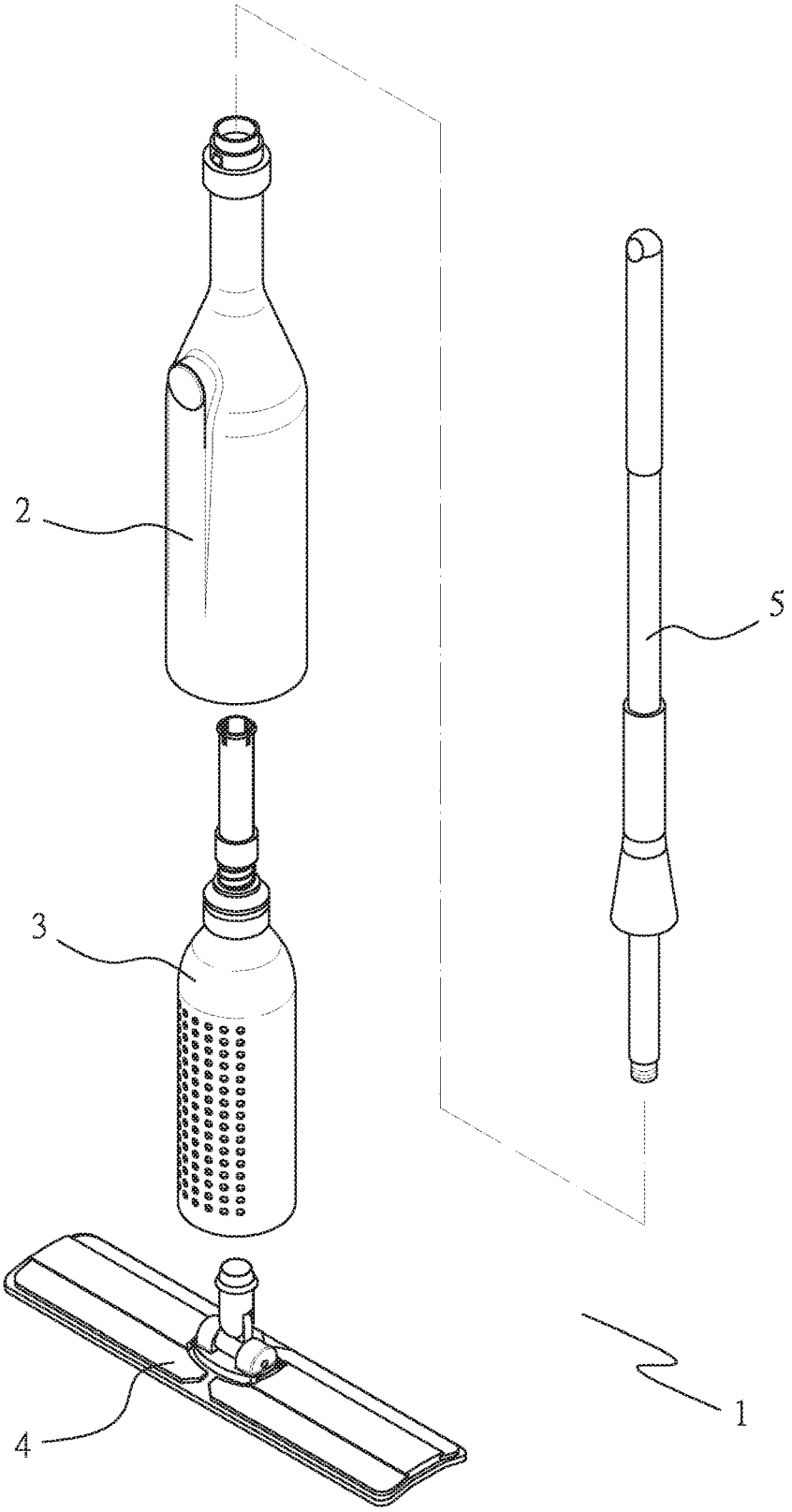
FIG. 2 is a perspective exploded view of the present invention.
Figure 3:
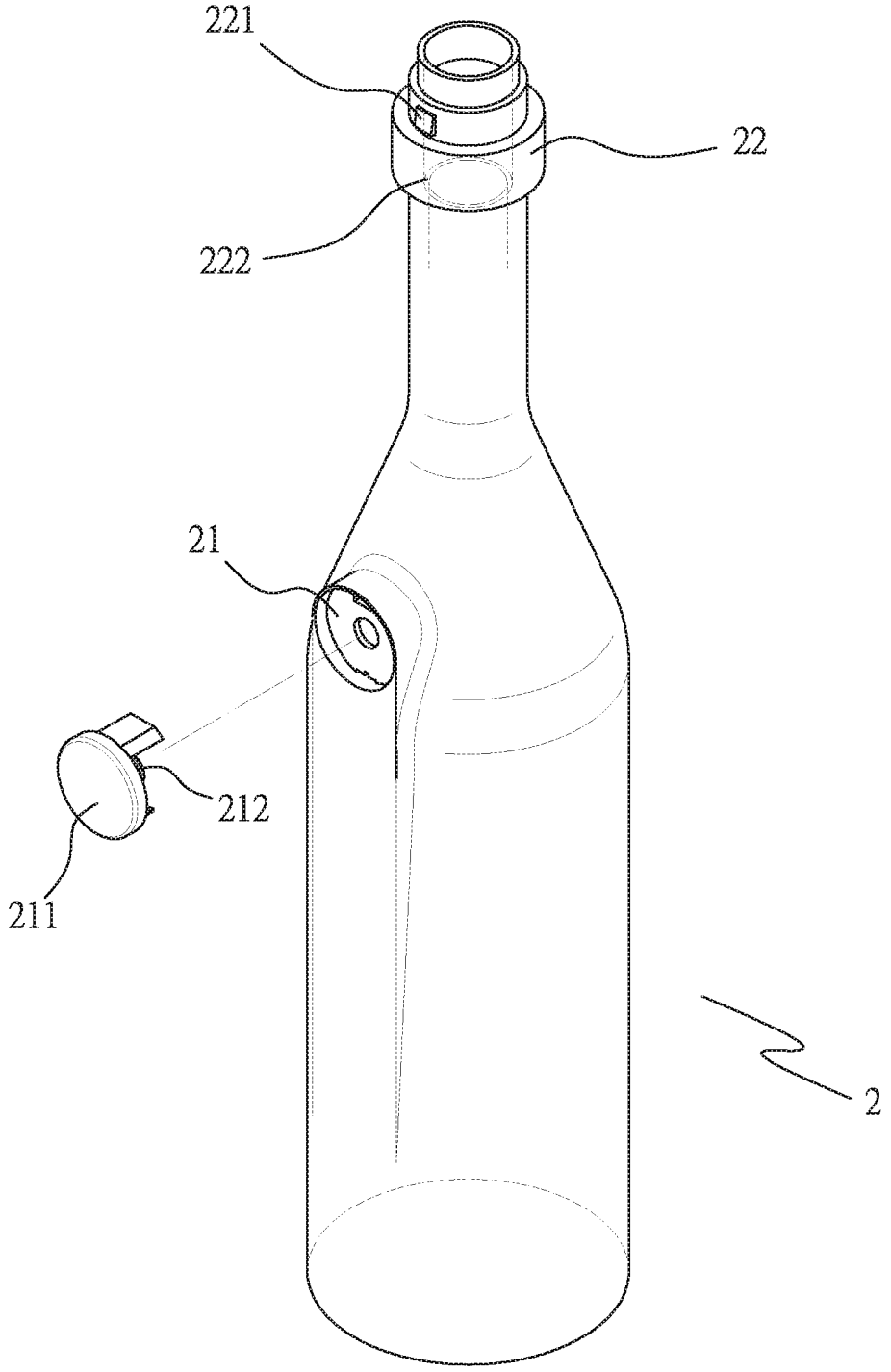
FIG. 3 is a first schematic view of a partial structure of the present invention.
Figure 4:
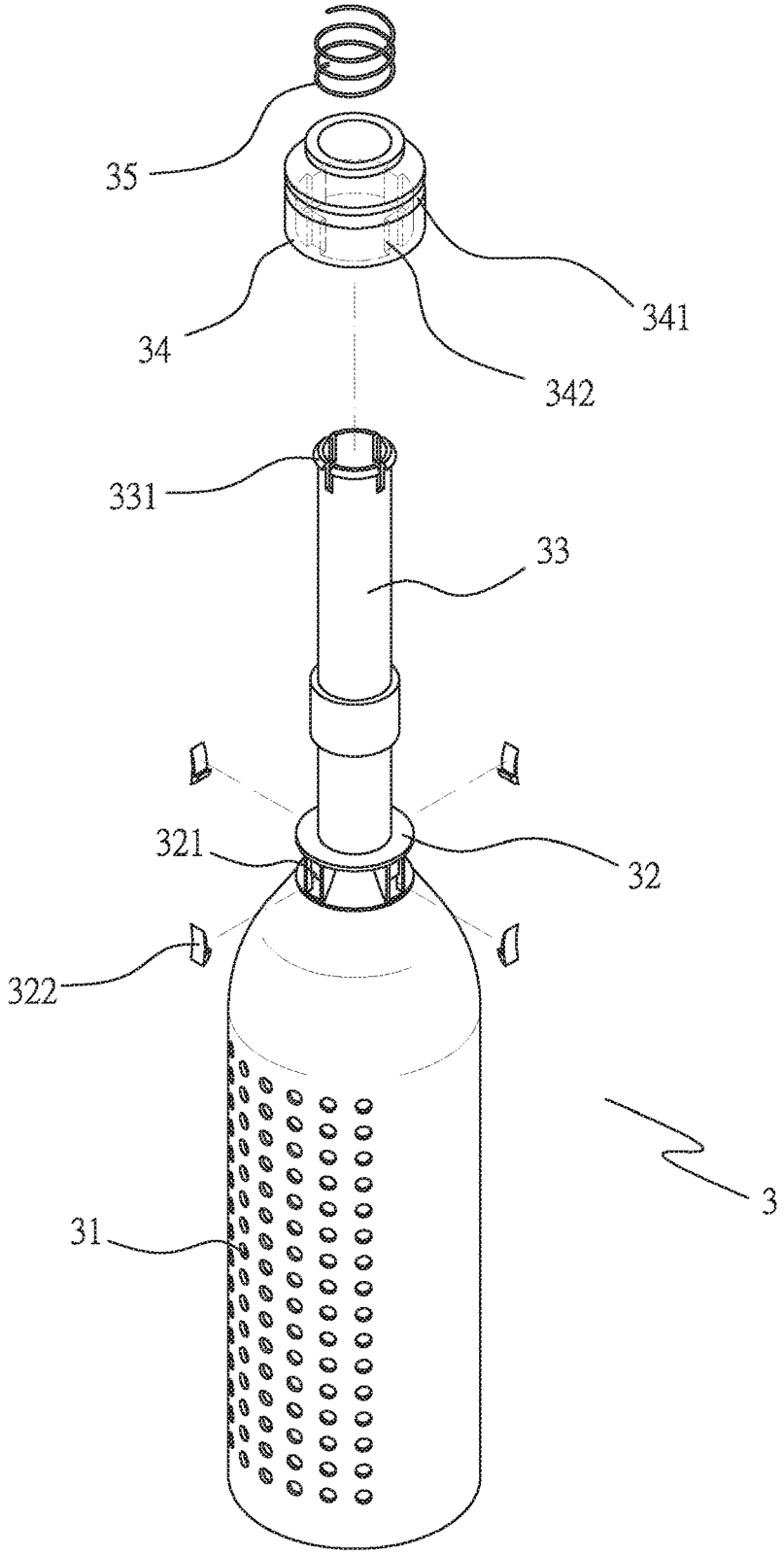
FIG. 4 is a second schematic view of a partial structure of the present invention.
Figure 5:
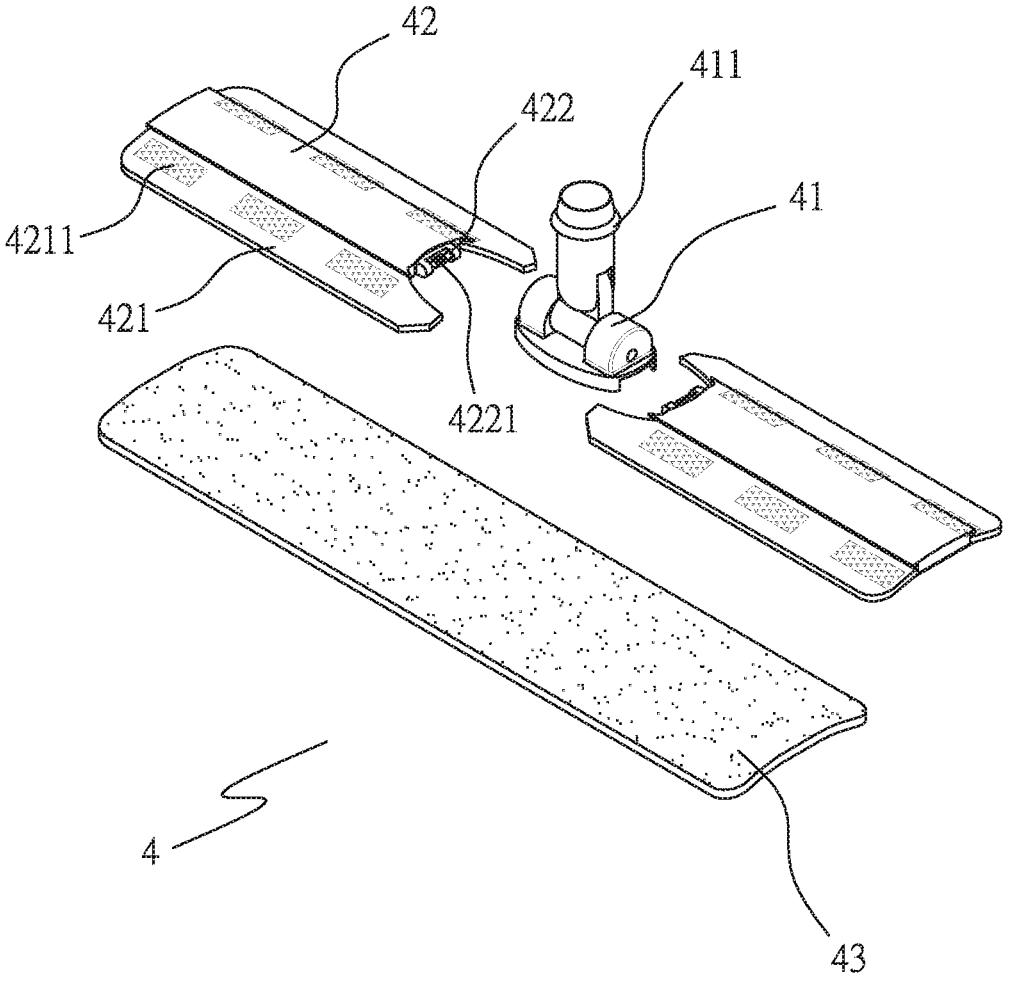
FIG. 5 is a third schematic view of a partial structure of the present invention.
Figure 6:
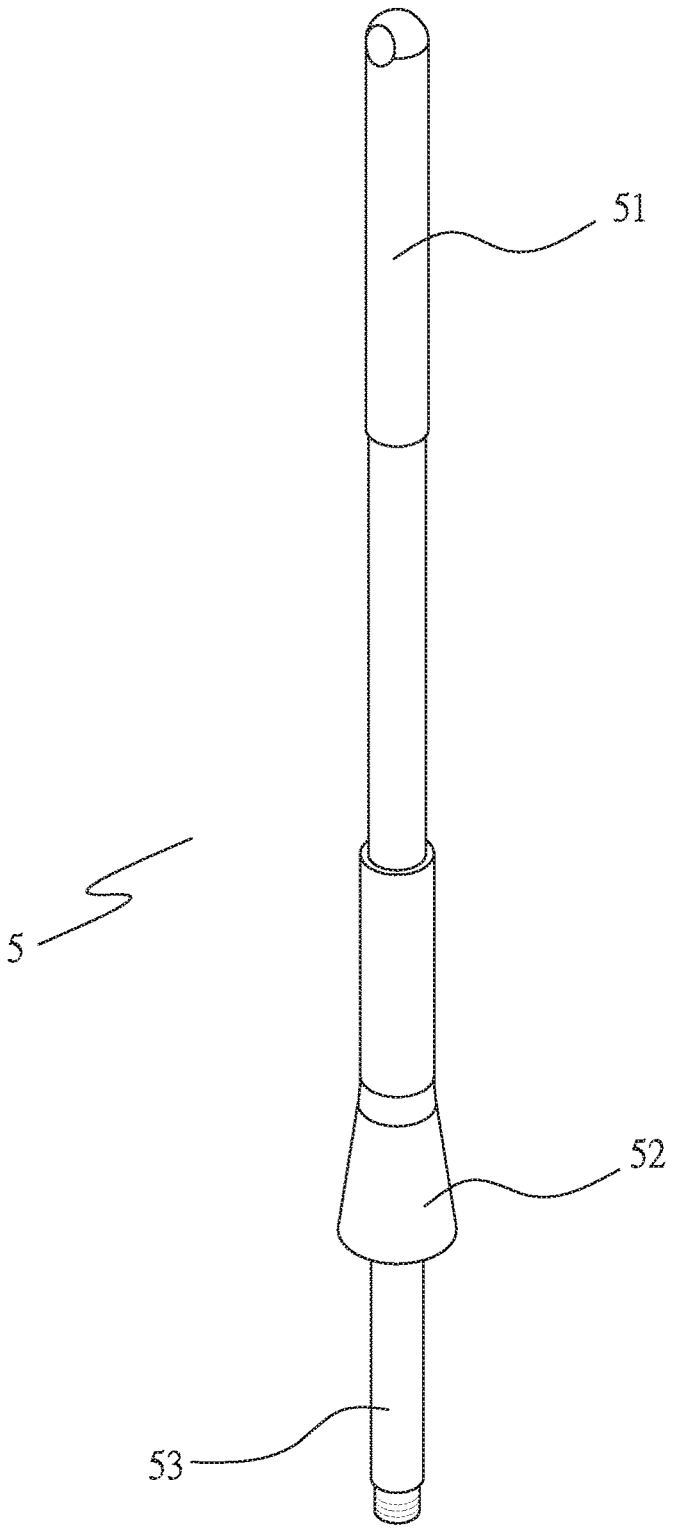
FIG. 6 is a fourth schematic view of a partial structure of the present invention.
Figure 7:
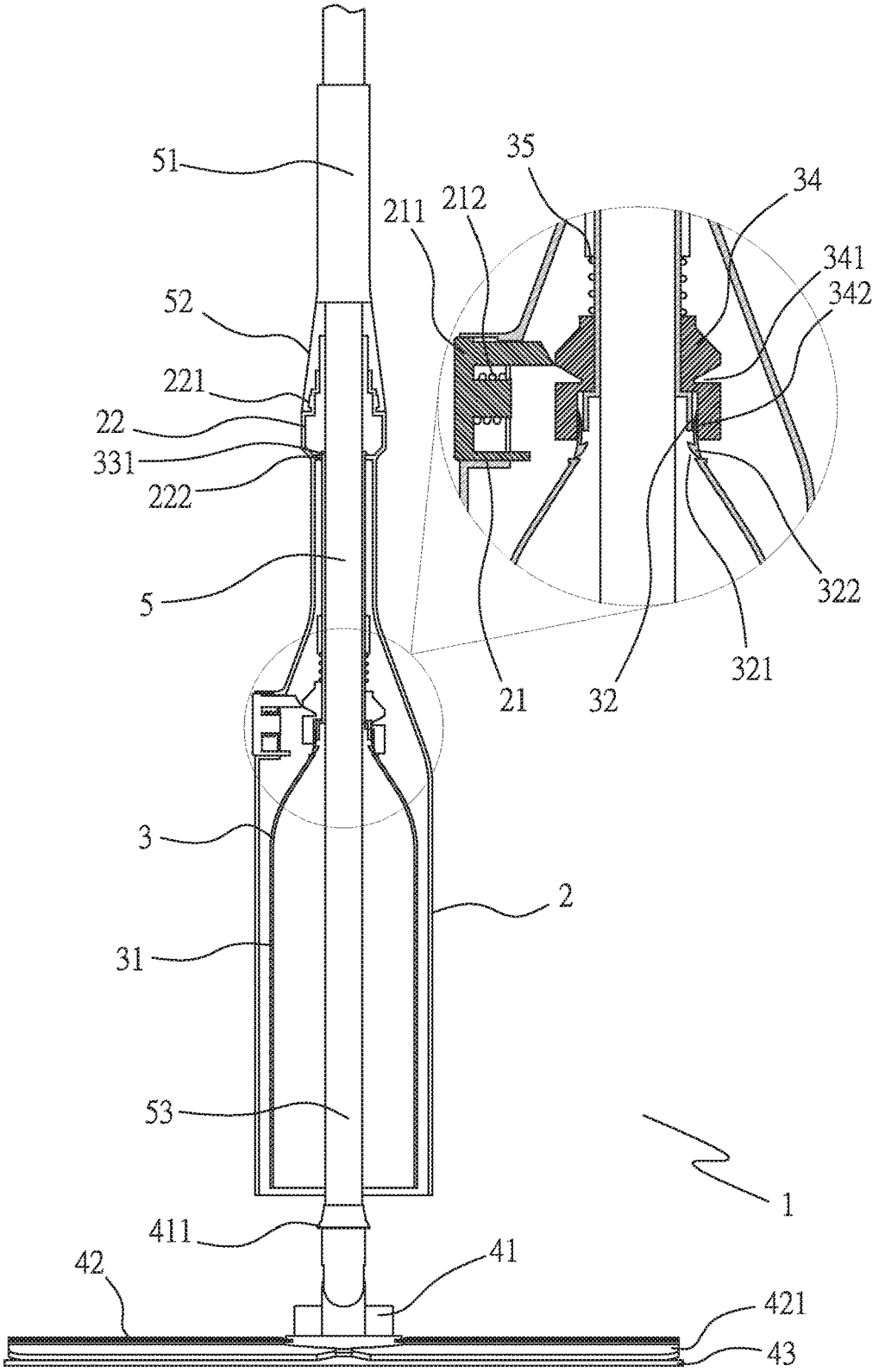
FIG. 7 is a cross-sectional view of the present invention.
Figure 8:
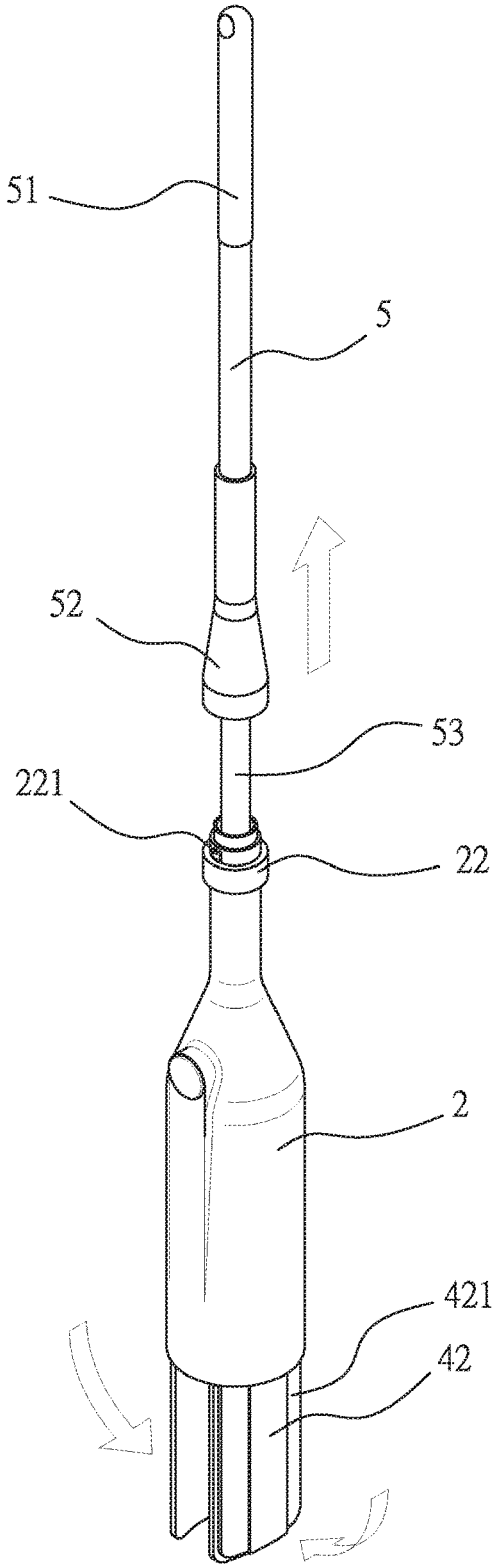
FIG. 8 is a first schematic view of a preferred embodiment of the present invention.
Figure 9:
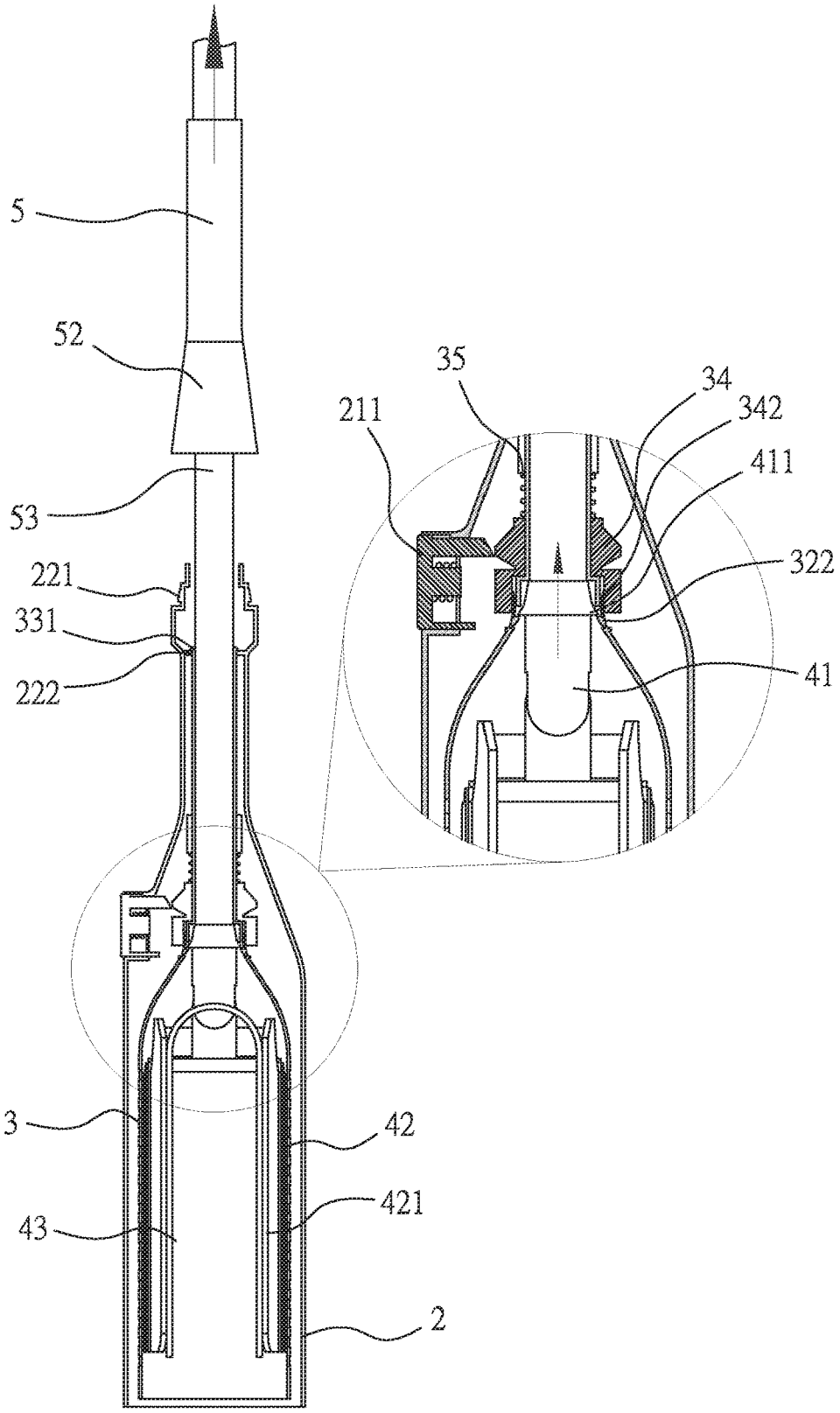
FIG. 9 is a second schematic view of a preferred embodiment of the present invention.
Figure 10:
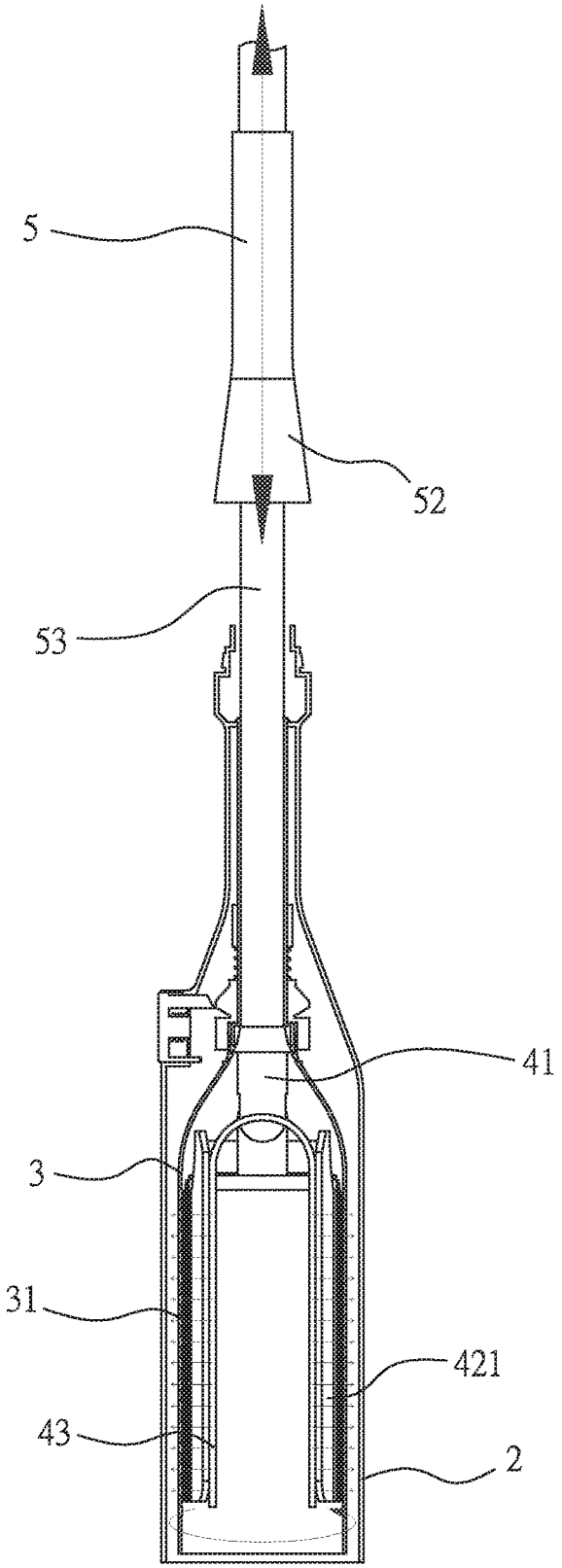
FIG. 10 is a third schematic view of a preferred embodiment of the present invention.
Figure 11:
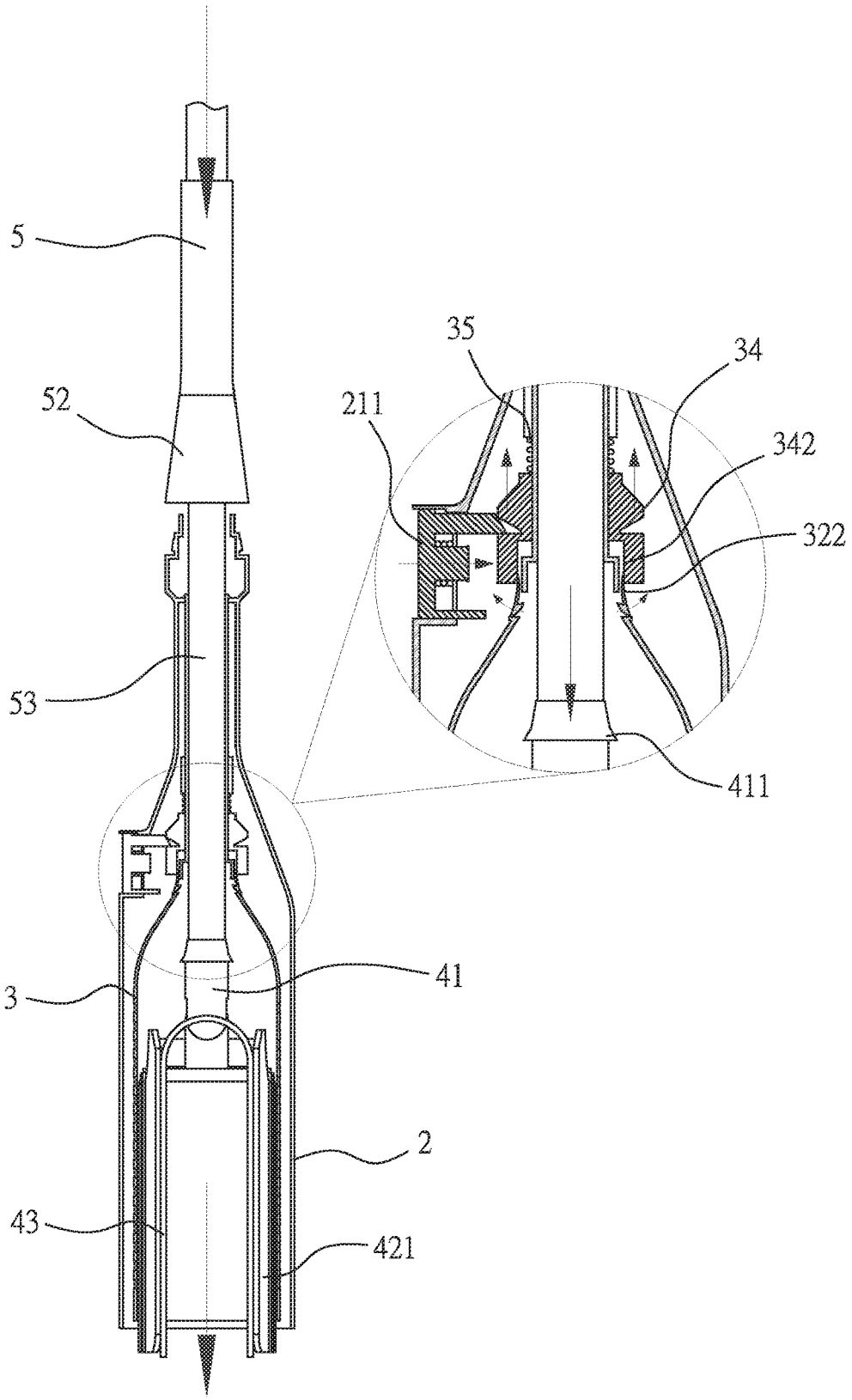
FIG. 11 is a fourth schematic view of a preferred embodiment of the present invention.

The foregoing and other technical contents, features and effects of the present invention will be clearly presented in the following detailed description of the preferred embodiments with reference to the drawings.

Please refer to FIG. 1, FIG. 2, FIG. 3, FIG. 4, FIG. 5, FIG. 6, FIG. 7, FIG. 8, FIG. 9, FIG. 10 and FIG. 11, which are perspective, perspective exploded, partial structural and cross-sectional views, as well as schematic view of the preferred embodiments of the present invention. It can be clearly seen from the figures that a mop device 1 of the present invention comprising:

an outer casing 2 having a slot 21 thereon and a connecting end 22, and a button 211 being further disposed on the slot 21;

a barrel 3 with a plurality of through holes 31 disposed on an outer surface thereof, one end thereof having a ring portion 32 and an extending portion 33, the barrel 3 being disposed in the outer casing 2 through the extending portion 33, and the ring portion 32 being sleevedly disposed with a movable member 34;

a cleaning assembly 4 located in the barrel 3, and the cleaning assembly 4 being composed of a multi-directional turn base 41, two plates 42 and a cleaning cloth 43; and a holding assembly 5 comprising a rod 51, a joint portion 52 and a movable rod 53, and through the movable rod 53 the holding assembly 5 penetrating through the outer casing 2 and the barrel 3, as well as connecting with the multi-directional turn base 41 of the cleaning assembly 4.

Wherein a bottom of the button 211 is further disposed with an elastic element 212.

Wherein an outer surface of the connecting end 22 has a plurality of protrusions 221, and an inside of the connecting end 22 has a flange 222.

Wherein the ring portion 32 has a plurality of grooves 321 thereon, and inside each of the grooves 321 is disposed with a fasten block 322.

Wherein an end of the extending portion 33 is further disposed with a plurality of convex edges 331, and the convex edges 331 are wedged with the flange 222 of the connecting end 22.

Wherein an outer surface of the movable member 34 has a ring groove 341, and an inside of the movable member 34 is disposed with a resisting protrusion 342.

Wherein the movable member 34 is further disposed with a resilient member 35 at one end thereof.

Wherein a corresponding side of the plate 42 is disposed with a side plate 421, and the side plate 421 is disposed with a plurality of attaching members 4211 of VELCRO® hook and loop fastener thereon so that the cleaning cloth 43 can be adhered on the side plates 421.

Wherein one end of the plate 42 is disposed with a pivoting block 422, the pivoting block 422 is disposed with a torsional spring 4221, and through the pivoting block 422 the plate 42 is pivotally connected to the multi-directional turn base 41.

When the mop device 1 is in use, the cleaning cloth 43 on the side plates 421 is controlled by holding the holding assembly 5 to clean a specific area. At this time, the joint portion 52 of the holding assembly 5 is interconnected with the connecting end 22 of the outer casing 2, and mainly to move the movable rod 53 downward to expose the entire cleaning assembly 4.

After cleaning is performed, the cleaning cloth 43 needs to be washed by clean water, and the cleaning cloth 43 has absorbed a considerable amount of water. At this time, the joint portion 52 of the holding assembly 5 is first detached from the connecting end 22 of the outer casing 2, and the cleaning assembly 4 is pulled up through the rod 51, so that the cleaning assembly 4 is located in the barrel 3. Finally, hold the rod 51 and move it upward and downward reciprocatically to drive the barrel 3 and the cleaning assembly 4 to rotate, whereby the centrifugal force of rotation can cause the water adsorbed by the cleaning cloth 43 to discharge from the through holes 31 of the barrel 3 to achieve the purpose of dewatering.

In the above, after the cleaning assembly 4 is pulled up, a fasten portion 411 of the multi-directional turn base 41 is wedged on the fasten blocks 322 of the barrel 3, so that the cleaning assembly 4 can be stably located in the barrel 3. At this time, since the movable member 34 is affected by an elasticity of the resilient member 35, the inner resisting protrusion 342 is pressed against the fasten blocks 322, so that the fasten portion 411 can be wedged on the fasten blocks 322. Additionally, since the plates 42 of the cleaning assembly 4 are affected by an elasticity of the torsional springs 4221, the plates 42 can be pressed against an inner wall of the barrel 3, and therefore, when the rod 51 is moved upward and downward reciprocatically, the barrel 3 and the cleaning assembly 4 are rotated at the same time.

After the dewatering of the cleaning cloth 43 is complete, the button 211 of the outer casing 2 is pressed, so that the button 211 is guided by the ring groove 341 of the movable member 34, thereby pressing the movable member 34 to move upward. At this time, since the fasten blocks 322 are no longer restrained by the resisting protrusion 342, so that the fasten portion 411 can be detached from the fasten blocks 322, whereby the entire cleaning assembly 4 can be exposed so that the cleaning cloth 43 can be used again to perform cleaning.

Figure 12:
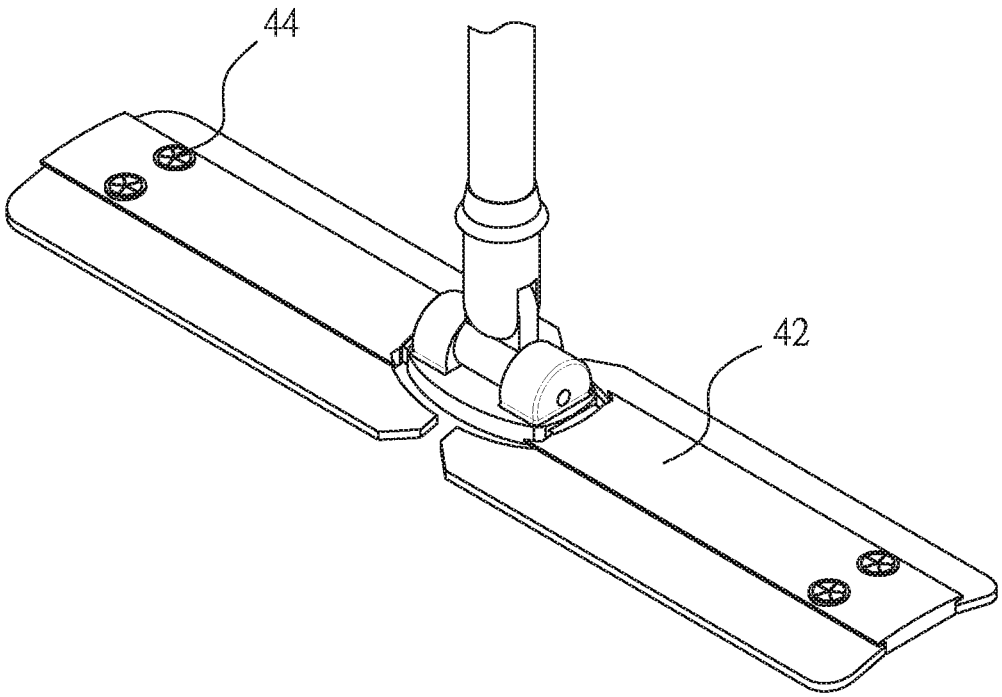
FIG. 12 is a schematic view of a further embodiment of the present invention.
Figure 13:
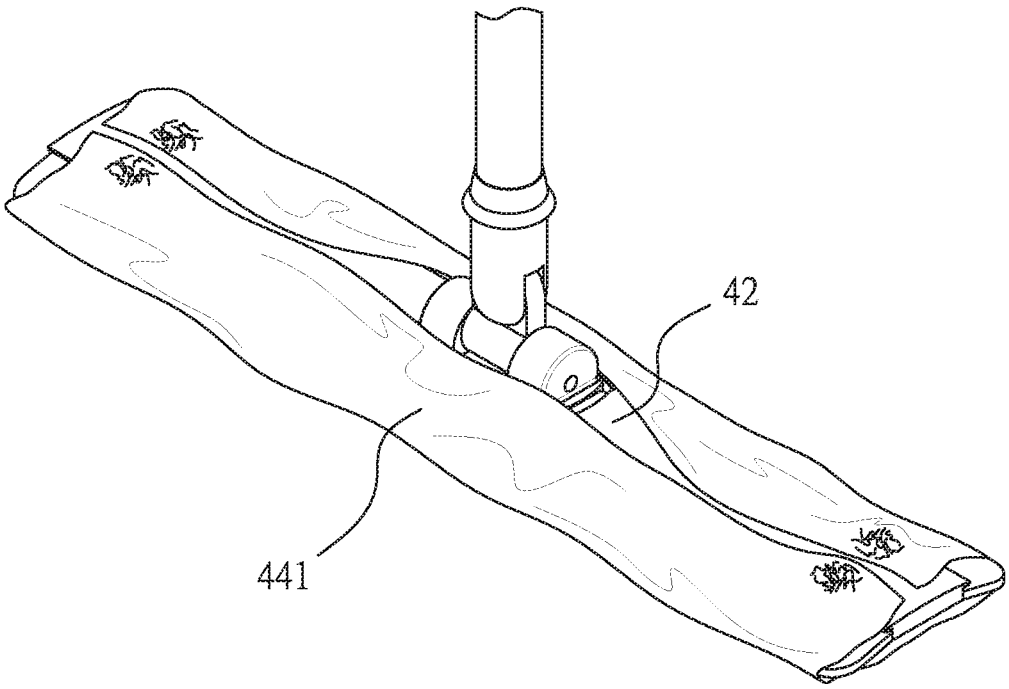
FIG. 13 is a schematic view of a further embodiment of the present invention.

In addition, as shown in FIG. 12 and FIG. 13, a plurality of fixing holes 44 can be further disposed on the plates 42, and a wiping paper towel 441 can be fixed outside of the plates 22 through the fixing holes 44, thereby performing a different degree of cleaning.

In summary, compared to the various defects and inconveniences of the conventional mops, the mop device 1 of the present invention is specially designed with the outer casing 2, the barrel 3, the cleaning assembly 4 and the holding assembly 5, without the need of preparing a container additionally, to allow the user to perform upward and downward movements reciprocatically through holding the rod 51, thereby achieving dewatering smoothly and quickly. Furthermore, through the design that the cleaning assembly 4 can be pulled up and placed in the barrel 3, the mop device 1 can be conveniently stored away by the user when not in use.

It is to be understood that the above description is only preferred embodiments of the present invention and is not used to limit the present invention, and changes in accordance with the concepts of the present invention may be made without departing from the spirit of the present invention, for example, the equivalent effects produced by various transformations, variations, modifications and applications made to the configurations or arrangements shall still fall within the scope covered by the appended claims of the present invention.

What is claimed is:

1. A rotary dewatering mop device, comprising:

an outer casing having a slot thereon and a connecting end, and a button being further disposed on the slot, wherein an outer surface of the connecting end has a plurality of protrusions, and an inside of the connecting end has a flange;

a barrel with a plurality of through holes disposed on an outer surface thereof, one end thereof having a ring portion and an extending portion, the barrel being disposed in the outer casing through the extending portion, and the ring portion being sleevedly disposed with a movable member;

a cleaning assembly located in the barrel, and the cleaning assembly being composed of a multi-directional turn base, two plates and a cleaning cloth; and a holding assembly comprising a rod, a joint portion and a movable rod, and through the movable rod the holding assembly penetrating through the outer casing and the barrel, as well as connecting with the multi-directional turn base of the cleaning assembly.

2. The rotary dewatering mop device as claimed in claim 1, wherein a bottom of the button is further disposed with an elastic element.

3. The rotary dewatering mop device as claimed in claim 1, wherein the ring portion has a plurality of grooves thereon, and inside each of the grooves is disposed with a fasten block.

4. The rotary dewatering mop device as claimed in claim 1, wherein an end of the extending portion is further disposed with a plurality of convex edges.

5. The rotary dewatering mop device as claimed in claim 1, wherein an outer surface of the movable member has a ring groove, and an inside of the movable member is disposed with a resisting protrusion.

6. The rotary dewatering mop device as claimed in claim 1, wherein the movable member is further disposed with a resilient member at one end thereof.

7. The rotary dewatering mop device as claimed in claim 1, wherein a corresponding side of each of the plates is disposed with a side plate, and the side plate is disposed with a plurality of attaching members of hook and loop fastener thereon.

8. The rotary dewatering mop device as claimed in claim 1, wherein one end of the plate is disposed with a pivoting block, the pivoting block is disposed with a torsional spring, and through the pivoting block the plate is pivotally connected to the multi-directional turn base.

9. The rotary dewatering mop device as claimed in claim 1, wherein the plate is further disposed with a plurality of fixing holes.

* * * * *